United States Patent [19]

Anderson et al.

[11] Patent Number: 4,739,326

[45] Date of Patent: Apr. 19, 1988

[54] FAULT FLAG DRIVER

[75] Inventors: William P. Anderson, S. Hamilton, Mass.; Jay S. Blosser, Cincinnati, Ohio; Joseph M. Buemi, Jr., Taylor Mill, Ky.; Albion R. Fletcher, Jr., Braintree, Mass.; Mark P. Horujko, Fairfield, Ohio; Domingo T. See, Jr., Hamilton, Ohio; Arthur E. Smith, Topsfield, Mass.

[73] Assignee: General Electric Company, Cincinnati, Ohio

[21] Appl. No.: 565,676

[22] Filed: Dec. 27, 1983

[51] Int. Cl.[4] ..... G08B 21/00

[52] U.S. Cl. ..... 340/945; 324/133; 340/518; 340/664; 340/825.17

[58] Field of Search ..... 340/945, 815.05, 815.29, 340/347 DD, 524, 971, 518, 825.16, 825.17, 764, 659, 654, 664, 644; 361/96, 97, 143, 171, 58, 156, 171, 173; 324/133, 418–419; 455/297, 307; 369/21

[56] References Cited

U.S. PATENT DOCUMENTS

| | | | |
|---|---|---|---|
| 2,713,157 | 7/1955 | Collins | 340/213 |
| 2,799,846 | 7/1957 | Negrin et al. | 340/213 |
| 2,985,869 | 5/1961 | Arrasmith | 340/815.05 |
| 3,015,702 | 1/1962 | Vogel et al. . | |
| 3,471,652 | 10/1969 | Moore et al. . | |
| 3,581,014 | 8/1971 | Vogel | 340/524 |
| 3,603,948 | 9/1971 | Medlinski | 340/214 |
| 3,707,714 | 12/1972 | Plumley | 340/347 DD |
| 3,772,686 | 11/1973 | Chardon | 340/373 R |
| 3,839,707 | 10/1974 | Woodward et al. | 340/524 |
| 3,999,175 | 12/1976 | Thibodeau | 340/644 |
| 4,034,360 | 7/1977 | Schweitzer, Jr. | 324/133 |
| 4,063,175 | 12/1977 | Friedman | 455/297 |
| 4,101,826 | 7/1978 | Horsitmann | 324/133 |
| 4,106,012 | 8/1978 | Knight | 340/524 |
| 4,165,528 | 8/1979 | Schweitzer, Jr. | 361/143 |
| 4,251,770 | 2/1981 | Schweitzer, Jr. | 324/133 |
| 4,424,512 | 1/1984 | Schweitzer, Jr. | 324/133 |
| 4,498,075 | 2/1985 | Gaudio | 340/524 |
| 4,516,076 | 5/1985 | Pillari et al. | 324/418 |
| 4,536,758 | 8/1985 | Schweitzer, Jr. | 324/133 |

OTHER PUBLICATIONS

IBM Technical Disclosure, "First Error or Event Sensing", vol. 15, No. 10, Mar. 1973, pp. 3203–3204.

*Primary Examiner*—Donnie L. Crosland
*Assistant Examiner*—Brent A. Swarthout
*Attorney, Agent, or Firm*—Derek P. Lawrence

[57] ABSTRACT

The present apparatus relates to nonvolatile fault flags for use in aircraft. The term "flag" refers to an electromechanical indicator which displays a human-readable signal which identifies a fault. A fault is a malfunction occurring in the aircraft. The term "nonvolatile" refers to the feature that the signal is not lost when electrical power is terminated to the indicators. In addition, apparatus are provided for displaying the first, and only the first, fault signal received by the indicator, and for the prevention of triggering of the indicator by spurious signals.

2 Claims, 2 Drawing Sheets

FAULT FLAG DRIVER

The Government has rights in this invention pursuant to Contract No. N00019-80-C-0326 awarded by the Department of the Navy.

The invention relates to devices which generate a permanent record of the occurrence of one of a plurality of events, as a malfunction in a gas turbine engine. In aircraft applications, such devices are commonly called fault flags.

BACKGROUND OF THE INVENTION

Jet fighter aircraft, in being complex machines which are subject to rigorous demands in operation, occasionally develop minor malfunctions. Some types of these malfunctions can be difficult to detect because the aircraft sometimes contains corrective apparatus which replaces, either actually or by simulation, the malfunctioning component.

An example of simulated replacement is found in the electronic control system of some gas turbine engines which power the aircraft. Such a control system receives inputs from, for example, temperature sensors. If a temperature sensor should fail, thus providing no input or a wild input, the control resorts to a nominal, default, value, which is artificially generated. The artificially generated value in many cases provides such satisfactory operation of the engine that the pilot of the aircraft might not notice a degradation in engine performance despite the failure of the temperature sensor. Thus, apparatus which records and identifies the component failure independent of the pilot is desirable.

Such devices are commonly called fault flags, because they generate a signal ("flag") which indicates the occurrence of the component failure ("fault"). Some fault flags, as used in the art, are not easily readable by aircraft maintenance personnel. Some of them must be connected to external computer circuitry or meters for reading.

OBJECTS OF THE INVENTION

It is an object of the present invention to provide a new and improved apparatus for identifying and recording the occurrence of component failures in aircraft.

It is a further object of the present invention to provide failure indicators for aircraft components which yield failure information in human-readable form.

It is a further object of the present invention to provide an aircraft failure sensor which provides a recorded indicia which indicates the occurrence of a component failure which indicia is nonvolatile in the sense that it will survive the termination of electric power to the sensor.

SUMMARY OF THE INVENTION

One form of the present invention includes a nonvolatile fault indicator for use in an aircraft in which a plurality of electromechanical indicators are first biased in an initialized state and display a first visual signal. Each indicator responds to one bit of a digital fault signal which is applied to the plurality of indicators. After the indicators change state in response to the fault signal, the indicators are disabled from subsequent changes in state. A resetting means is provided for returning the indicators to their initialized states.

DETAILED DESCRIPTION OF THE INVENTION

Figure 1:
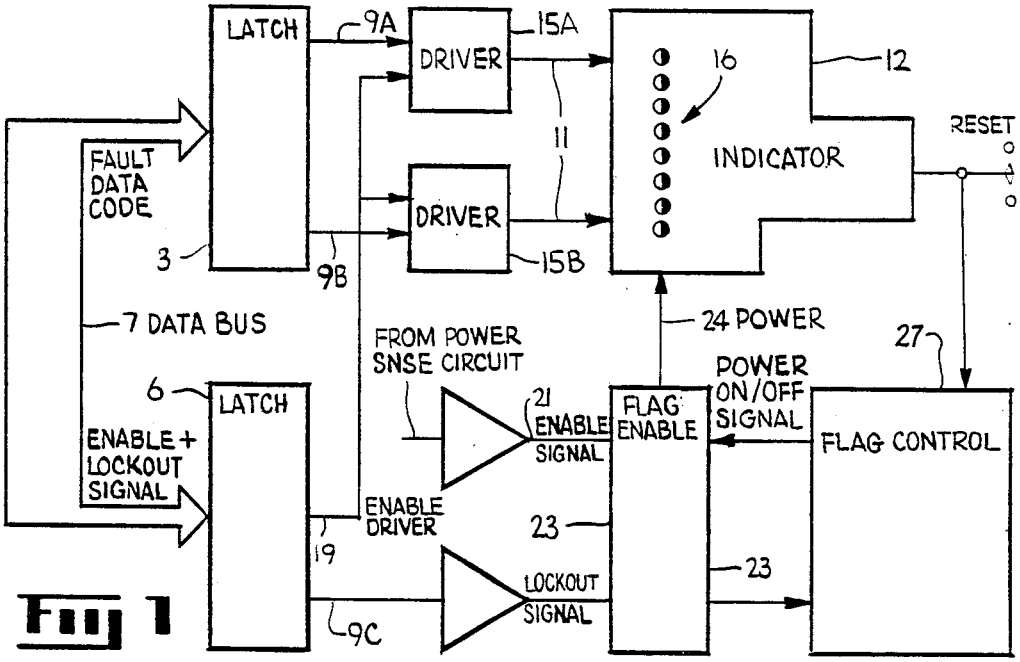
FIG. 1 illustrates a block diagram of one form of the present invention.

A brief description of the overall functioning of the present invention will be first given. As shown in FIG. 1, latches 3 and 6 receive signals labeled "fault data code" and "enable+lockout signals." These signals are carried by a data bus 7 which is used in conjunction with an electronic control (not shown) which controls a gas turbine engine. Many such controls are well known in the art. As is also well known in the art, a microprocessor is commonly included in the control and the microprocessor causes the signal which is present on the data bus 7 to change at a very rapid rate, frequently at megahertz rates and faster.

The computer program which derives the microprocessor is programmed such that, at predetermined intervals, tests are made upon selected engine components to ascertain whether they are functioning properly. If the control detects a malfunction, it generates the fault data code, which is a binary number identifying the fault, and transmits the fault data code to latch 3. The control also generates the enable and lockout signals which it transmits to latch 6. Latches 3 and 6 are activated to accept and latch the data by a clock signal provided by the control and carried on line 18 (shown in FIGS. 2 and 3), so that subsequent changes in the data on the data bus 7 caused by the microprocessor do not then affect the data on latch outputs 9A–C. That is, only one fault code (namely, the first) is latched by latches 3 and 6 and the code does not subsequently change.

The latch outputs in the preferred embodiment comprise transistor-transistor logic (TTL). Thus, the latches 3 and 6 supply voltage which range from zero to approximately 3 or 4 volts, and currents of a few milliamps. Since the latch outputs 9A–B will be used to drive electromagnets (which require more current than TTL devices normally supply) which are contained in the electromagnetic indicator 12, their currents or voltages or both must be amplified and this is done by drivers 15A–B. The drivers 15A–B are connected to inputs 11 of indicator 12, which includes eight electromechanical indicators 16, each of which responds to one of the signals on the data bus 7, thus providing as output a mechanical, visual, indication (in the form of a color change) of the signals contained on the data bus 7. As will be later described, the electromechanical indicators 16 are designed such that they retain their visual information even in the event of a power failure and they are thus termed nonvolatile.

The Applicants have found that the mere latching of the data bus signals by latches 3 and 6, together with amplification of them by drivers 15A–B and the transmission of the amplified signals to the indicator 12 are, of themselves, insufficient to provide reliable failure indications. For example, during system power-up, spurious signals are generally present on many of the lines, including indicator inputs 11. The spurious signals can prompt the indicator 12 to falsely display a fault condition when no such condition actually exists. To counter this false display problem, during system power-up, the microprocessor, through line 19 (which is connected to the enabling inputs of drivers 15A–B), disables these drivers so that no signal can be presented to indicator inputs 11.

As another example, a problem arises if two faults occur, one after the other. For example, a first fault data code might be presented to driver inputs 9A–B followed by enabling of enable line 21, which causes the indicator 12 to display signals corresponding to the first fault signal. The occurrence of the second fault would cause this process to be repeated, thus eliminating the record of the first fault and replacing it in the indicator with a record of the second. In order to prevent this elimination and replacement, flag-enable block 23 operates as follows.

Following the application of a fault signal to indicator inputs 11, the microprocessor generates a signal on flag lockout line 9C, which has the result of pulling the voltage on line 9C to 5 volts. This causes the flag enable block 23 to refuse to supply power on line 24 to the indicator 12, thus preventing signals on indicator inputs 11 from activating the indicators 16, so that the second fault does not erase the record of the first fault. As stated above, the termination of power does not affect the display shown by the electromechanical indicators 16. This generalized description will now be expanded into greater detail.

Figure 2:
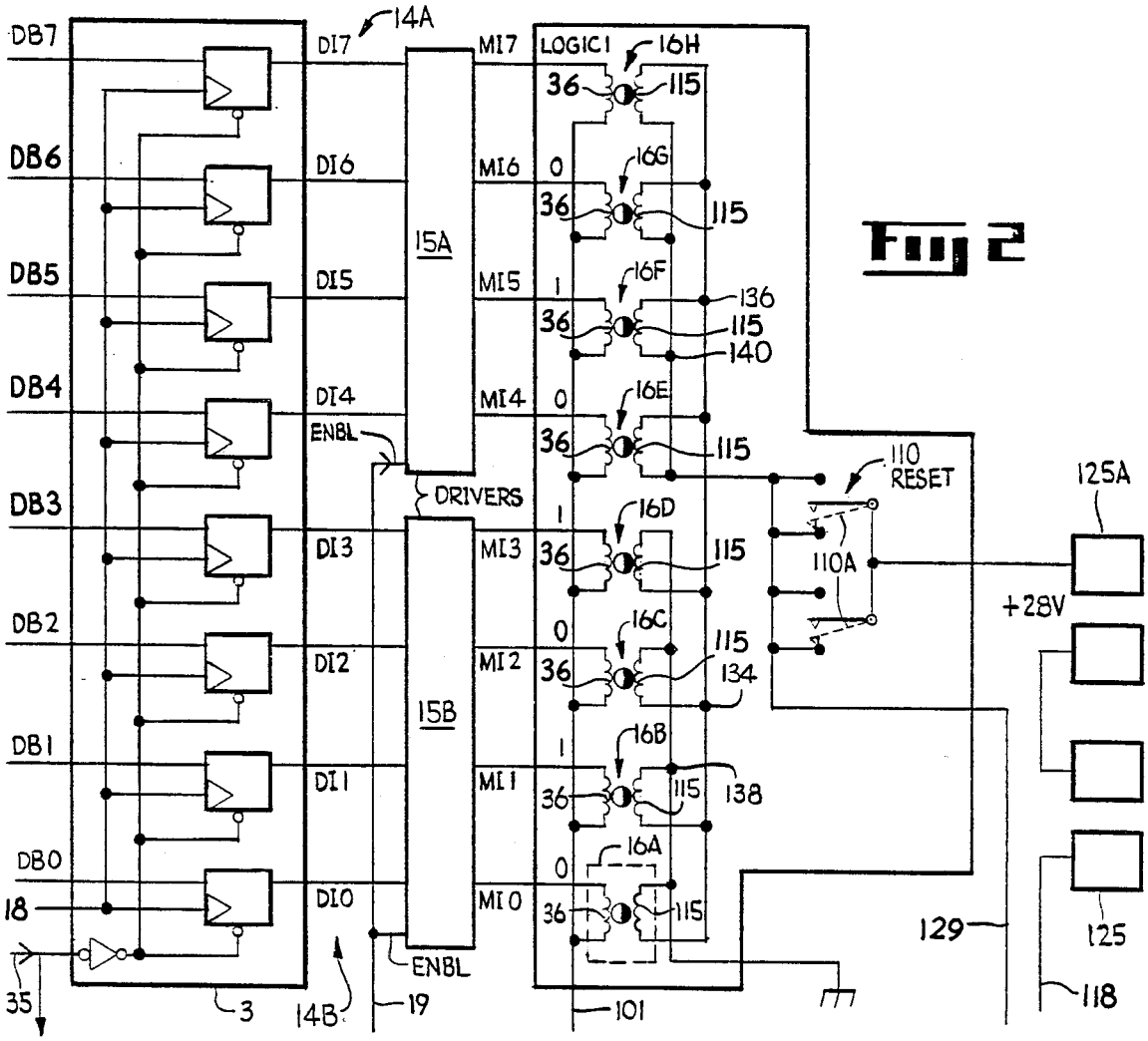
FIGS. 2 and 3 illustrate an electrical schematic of one form of the present invention.
Figures 3, 4, 5:
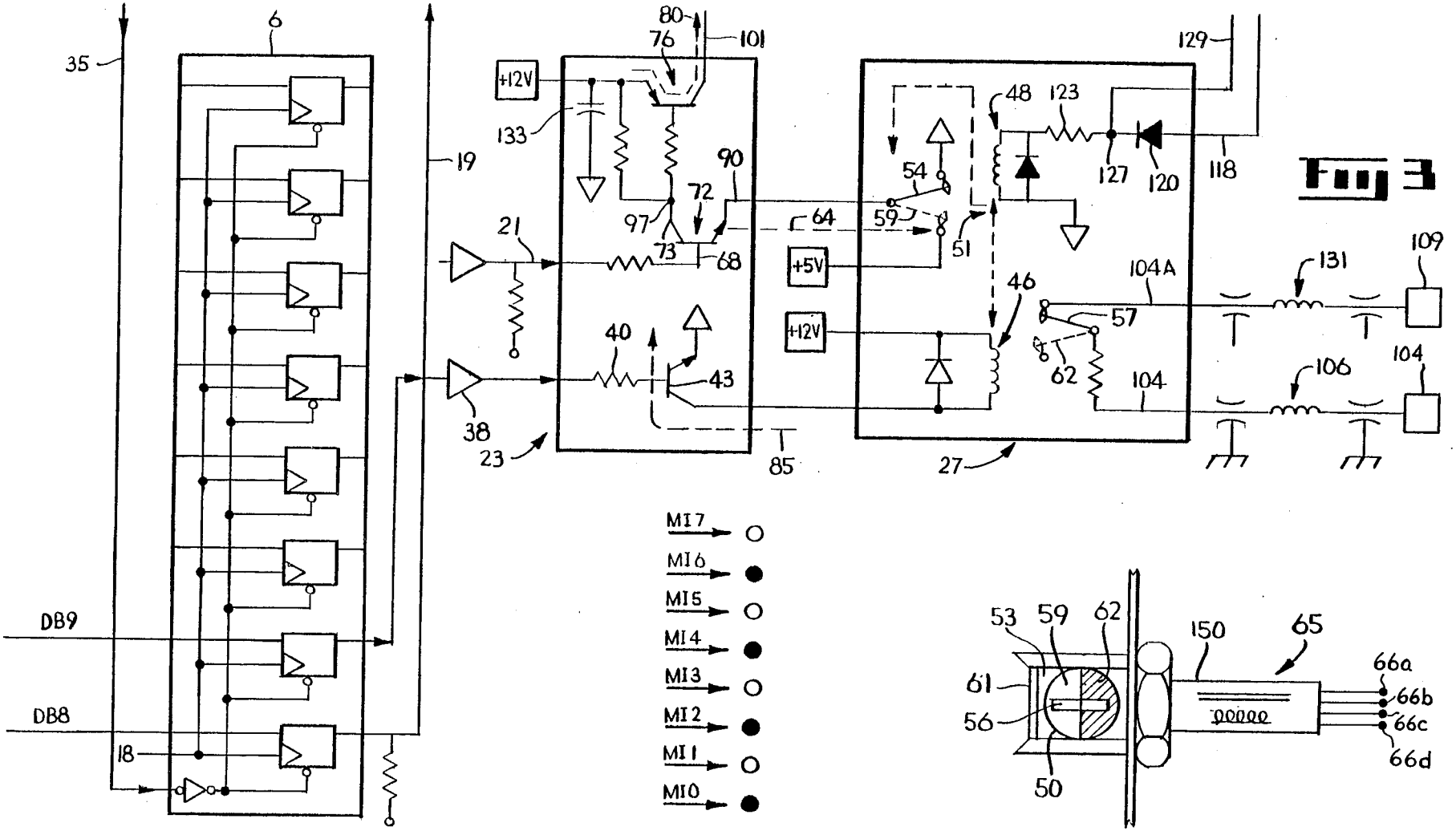
FIG. 4 illustrates one visual signal provided by the electromechanical indicators 16A–16H in FIG. 2.
FIG. 5 illustrates one type of electromechanical indicator which can be used in the present invention.

FIGS. 2 and 3 contain a schematic diagram of the electronic circuitry contained in one form of the present invention. FIGS. 2 and 3 are considered to be sufficiently detailed so that, when viewed with the following description of its functioning, it will enable one skilled in the art to construct one embodiment of the present invention.

Data bus lines DB0–7 carry the fault data code, an 8-bit binary word. This binary word identifies the aircraft system fault which occurred and this binary word is obtained from the engine control (not shown) through the use of electronic circuitry and computer programming known in the art. Following generation of the fault data code, a signal on line 18 provided by the control clocks the data into the latch 3 where it is held and presented to driver input bus 14A. For example, an 8-bit word such as 01010101 contained respectively on lines DB0–DB7 will also be contained on driver input (DI) lines DI0–DI7. As is apparent from the circuit connections of FIGS. 2 and 3, a signal on line 35 can reset the latches 3 and 6 when necessary. While the fault code is applied to latch 3, line DB8 on latch 6 is held low, which enables the drivers 15A and B, thus amplifying and transmitting the signal on DI0–7 to mechanical indicator inputs MI0–MI7. These inputs each lead to a coil 36 associated with each electromechanical indicator 16. Further, line DB9 in FIG. 3 is also held low. This low voltage signal is transmitted by way of amplifier 38 through resistor 40 to the base of transistor 43, keeping this transistor 43 turned off, and thus depriving relay coil 46 of power.

Relay coil 46 operates together with relay coil 48, as indicated by dashed arrows 51. Energizing coil 46 pulls relay reeds 54 and 57 to the dashed positions 59 and 62, while energizing of coil 48 pulls these reeds to the solid positions shown. Thus, when relay coil 46 is deprived of power, the reeds 54 and 57 are allowed to remain in the solid-line positionings shown, thereby completing a current path 64 from transistor 72 to ground. This current path allows the electromechanical indicators 16 to respond to signals on the MI bus as follows.

Previously, but after the system has stabilized upon power-up, the microprocessor applied a logic high signal on line 21 to the base 68 of transistor 72, thus driving the collector 73 low, thus turning on transistor 76, which thereby provides a current path from the 12-volt source as indicated by arrows 80. (Conversely, if the signal applied to base 68 were logic low, transistor 72 would be turned off, thus eliminating the current path 80. In this latter case, no power would reach the electromechanical indicators 16 and this situation will be further discussed later.) With the current path 80 established, current now can flow through those coils having a logic zero applied to their inputs, namely, coils attached to MI0, MI2, MI4, and MI6 in this case. Accordingly, the electromechanical indicators 16, in response to the signal present on the MI bus, now display the pattern shown in FIG. 4.

One such indicator which can be used is in the BHGD27T series, 12-volt variety, of miniature Built-In Test indicators (BITEs). These are available from Minelco Company, 135 So. Main Street, Thomaston, Conn. This type of indicator is schematically shown in FIG. 5 wherein a sphere 50 freely floats in an oil bath 53 and contains a magnet 56. The sphere is painted white in region 59 and black in region 62. The sphere 50 is visible through a window 61. An electromagnet 65 (corresponding to the coils 36 and 115 in FIG. 2) receives power from leads *66a* and *66b* which correspond to the terminals of coils 36 and leads *66c* and *66d* which correspond to the terminals of coils 115. The magnet 56 contained within the sphere aligns its own magnetic dipole with the direction of the field produced by electromagnet 65.

After the electromechanical indicators 16 have changed their states in response to the signal applied to the MI bus, and after allowing approximately 100 microseconds for the BITEs to stabilize, the control applies a high signal to DB9 in FIG. 3. This signal is amplified by amplifier 38 and fed through resistor 40 to turn on transistor 43, thereby completing the circuit indicated by arrow 85 and energizing relay coil 46 (which is a magnetically latched relay), thus pulling reeds 54 and 57 into the phantom positions 59 and 62. This backbiases transistor 72, in bringing emitter lead 90 to approximately the same potential as base lead 68, thus turning off the transistor 72. This turn-off allows node 97 to be pulled to a high potential, thereby turning off transistor 76, thereby effectively creating an open circuit in line 101 which prevents current flow through coils 36. Thus, in a sense, the indicator 12 is inactivated. This current prevention prevents the subsequent application of fault data codes to data bus 7 from altering the display state of the indicator 12. This explains the power deprivation discussed in connection with lead 24 in FIG. 1.

Therefore, if the control detects additional faults, it is free to apply the error codes to data bus 7 and activate lines DB8 and DB9 in the manner described above, attempting to trigger the indicator 12, but triggering will be prevented by open circuit now seen in the turned off transistor 76. In this manner, one and only one (namely, the first) error code is stored in the indicator. The indicator 12 retains the visual display shown in FIG. 4 even after power is disconnected from it because the spheres 50 in FIG. 5 maintain their positions in the absence of current in electromagnet 65.

The energization of relay coil 46 causes reed 57 to disconnect line 104A from line 104, through electromagnetic interference (EMI filter) 106 and 131 thence to contacts 108 and 109. Contacts 108 and 109 are connected to an external indicator (not shown), such as an LED contained in the cockpit of the aircraft, which alerts the pilot that a fault has occurred.

A reset switch 110, when activated, as by moving switch 110 to the phantom position 110A, has a twofold effect. First, it drives current through coils 115 of the electromagnetic indicators 16, but in the opposite direction described above, thus rotating all the spheres 50 to their initialized state of each displaying its white surface. Second, current is supplied along path 129 to relay coil 48 to function to switch relay reeds 59 and 62 to their original, solid-line positions. This switching pulls emitter 90 in the flag-enable block to a low potential, thus bringing transistor 72 into conduction, thereby reestablishing current path 80 through transistor 76, thus allowing current passing through coils 36 to again rotate spheres 50 if signals are applied to leads MI0–MI7. In a sense, the indicator 12 is thereby re-activated.

A lead 118 is coupled through diode 120 to resistor 123 which allows external equipment (not shown) to test the system, as by applying a +28 volt signal to contact 125 to energize relay coil 48 to switch relay reeds 59 and 62 to the original positions 54 and 57. Diode 120 serves to isolate lead 118 from node 127 in the event that reset switch 110 is accidentally pressed at the same time signals are applied to contacts 125 and 125A. This serves to eliminate the problems caused by the possible application of two different 28 volt sources to the same node, namely node 127 in this case. EMI filter 131 functions to isolate the system shown in FIGS. 2 and 3 from the rest of the aircraft's electrical system in terms of electrical noise. Capacitor 133 in the flag-enable block 23 serves to reduce noise at node 97.

A commonly available voltage in an aircraft power system is 28 volts, which is the voltage shown as applied to lead 125A. However, BITEs 16 require a 12-volt power supply. Applicants resolve this discrepancy by connecting BITEs 16A–D in parallel and 16E–H in parallel and connecting these two groups of BITEs in series. That is, nodes 134 and 136 are at the same potential (28 volts), and nodes 138 and 140 are at zero and 14 volts, respectively. The BITEs have been found to tolerate 14 volts.

One embodiment of the present invention has been described wherein the data bus of a microprocessor in aircraft engine control is connected to a latch 3 which latch in data under microprocessor control. The latched data is presented to drivers 15A–B which are enabled by a signal on lead 19 from the microprocessor. If the drivers are enabled by flag-enable block 23 (that is, transistor 72 is turned on) the coils 36 to which logic zeros are applied then carry current and change the states of the spheres 50 to which they are connected. After a 100 millisecond delay for BITE stabilization, the microprocessor applies a lockout signal to DB9 which open-circuits the coils 36 through toggling relay reeds 54 and 57 to thereby turn off transistor 72, thus preventing subsequent current flow through any of the coils 36. The toggling of reed 57 also changes the signal present at contacts 108 and 109, thus alerting the pilot of the aircraft as to the occurrence of a fault. (As mentioned, the occurrence of the fault may not be noticeable in an alteration of the aircraft's performance, because of other safety features incorporated in the aircraft).

The indicator 12 is thus protected from an accidental change in state in three distinct ways. First, it possesses a mechanical toggling characteristic in that the spheres 50 are magnetically polarized by the interaction of their own self-contained permanent magnet 56 in FIG. 5 and a magnet (not shown) contained within the device body 150. Thus, the spheres 50 tend to rest either showing white or black and in no other position. The only influence which alters the state of a sphere 50 is current through coil 36. The second aspect of nonvolatility relates to these currents. The flag lockout signal on lead DB9 serves to prevent current from flowing through coils 36 by opening up transistor 76. Third, the loss of power to the entire system, as when an aircraft mechanic removes power, does not change the state of the spheres 50.

Thus, when the aircraft mechanic, perhaps when prompted to do so by the pilot who noticed the cockpit signal provided by contacts 108 or 109, examines the spheres 50, the mechanic sees an 8-bit binary number such as that shown in FIG. 4 (black=0, white=1). The mechanic will record the 8-bit number and look up particular fault identified by the 8-bit number in a table. In another embodiment of the present invention, one of the spheres, in this case, the sphere in BITE 16H indicates that the fault is one of a class of faults associated with the electronic engine control. Under this embodiment, the mechanic is instructed to first examine sphere in BITE 16H, and if that sphere so indicates, to immediately remove the electronic engine control, as the fault has occurred therein. A new control can be reinstalled, thus reducing down-time of the aircraft.

From one point of view, each of the plurality of electromechanical indicators 16 in FIG. 1 is responsive to one bit of the digital fault code signal which is presented to indicator 12 by drivers 15A–B. However, the electromechanical indicators 16 are only allowed to respond if flag enable block 23 is in the proper state. The proper state requires that transistor 72 in FIG. 3 complete a path to ground through relay reed 54 so that transistor 76 can conduct. With enable block 23 in this state, current is able to be supplied to the coils 36 in FIG. 2.

Flag control block 27 in FIG. 1 controls the state of the flag enable block 23 through the relays in FIG. 3. When the relay reed 54 is in the position shown, the enable block 23 is allowed to enable and disable current flow to coils 36, which apply magnetic fields to movable members taking the form of spheres 50 in FIG. 5. The magnetic field influences the spheres 50 to change state. When the relay reed 54 moves to the phantom position 59, the enable block 23 is prevented from enabling current to flow to the coils 36.

A biasing means in the form of the magnet discussed in connection with FIG. 5 tends to keep the sphere 50 in one of two states, despite termination of power to electromagnet 65. Of course, the current applied to electromagnet 65 on lines MI0–MI7 in FIG. 2 overcomes the bias and changes the state of sphere 50.

Numerous substitutions and modifications can be undertaken without departing from the true spirit and scope of the present invention. What is desired to be secured by Letters Patent of the United States is the following.

We claim:

1. An electromechanical indicator for receiving a digital fault code indicative of the occurrence of a fault in an aircraft, comprising:

(a) latching means for receiving and latching the fault code;

(b) driving means coupled to the latching means for receiving and amplifying the latched fault code and for presenting the amplified fault code to an indicator, the indicator comprising:

(i) a plurality of electromechanical indicators, each responsive to a respective bit of the fault code and each having:

(A) two display states and (B) biasing means for inhibiting change of the indicator from its present state;

(c) enabling means including:

(i) a first transistor through which electric current flows along a common supply line to the electromechanical indicators, (ii) a second transistor coupled to the first transistor for turning off and on the first transistor, and (iii) a third transistor for supplying current to a first relay coil;

(d) control means including:

(i) the relay coil of (c) (iii);

(ii) a pair of relay reeds magnetically toggled by the first relay coil and by a second relay coil, the relay reeds being pulled into a first position and latched by the passage of current through the first relay coil, the first position functioning to turn off the first transistor; and (iii) a second relay coil for driving the pair of reeds into, and latching them in, a second position by passage of current through the second relay coil, thereby allowing the first transistor to be turned on; and (e) resetting means coupled to the electromechanical indicators and to the second relay coil for:

(i) placing all of the indicators into a first, initialized state and (ii) driving the second reed into the state wherein the first transistor is able to be turned on.

2. An indicator according to claim 1 and further comprising filter means for isolating the first relay coil from electromagnetic interference and for transmitting information to the pilot of the aircraft indicative of the state of the first relay reed.

* * * * *